United States Patent [19]

Fricker

[11] Patent Number: 4,697,723

[45] Date of Patent: Oct. 6, 1987

[54] TENSIONING STRUCTURE FOR A SLIDING CLOSURE UNIT

[75] Inventor: Robert Fricker, Unterägeri, Switzerland

[73] Assignee: Stopinc Aktiengesellschaft, Baar, Switzerland

[21] Appl. No.: 842,808

[22] Filed: Mar. 21, 1986

[30] Foreign Application Priority Data

Apr. 10, 1985 [DE] Fed. Rep. of Germany ..... 3512798

[51] Int. Cl.[4] ..... C21C 5/46; B22D 41/08

[52] U.S. Cl. ..... 222/600; 222/512; 266/236

[58] Field of Search ..... 222/512, 600, 598, 561, 222/591; 251/176, 193, 326; 266/236, 271

[56] References Cited

U.S. PATENT DOCUMENTS

| | | | |
|---|---|---|---|
| 3,587,945 | 6/1971 | Lanatti et al. | 222/561 X |
| 3,604,603 | 9/1971 | Grosko et al. | 266/236 X |
| 3,727,805 | 4/1973 | Shapland | 222/600 |
| 3,765,579 | 10/1973 | Cramer et al. | 222/561 X |
| 3,921,866 | 11/1975 | Palazzo | 222/598 X |
| 3,926,406 | 12/1975 | Hind | 251/193 X |
| 4,253,647 | 3/1981 | Andres | 222/600 X |
| 4,570,908 | 2/1986 | King | 222/600 X |

FOREIGN PATENT DOCUMENTS 2146677 3/1972 Fed. Rep. of Germany .

*Primary Examiner*—Joseph J. Rolla
*Assistant Examiner*—Nils Pedersen
*Attorney, Agent, or Firm*—Wenderoth, Lind & Ponack

[57] ABSTRACT

A sliding closure unit includes a stationary refractory plate to be mounted on a metallurgical vessel, a movable refractory plate, a slide frame supporting the movable refractory plate and movable in a direction of movement between an open position with discharge openings in the movable and stationary refractory plates in alignment and a closed position with the discharge openings out of alignment, and tensioning devices on opposite sides of the movable refractory plates for pressing the movable refractory plate against the stationary refractory plate. The force of the tensioning structures is distributed evenly along the opposite sides of the movable refractory plate by strip members mounted in the slide frame for movement relative in the direction of the thickness thereof. A respective strip member is positioned on each opposite side of the movable refractory plate and is positioned between the tensioning structure on such side and the bottom surface of the movable refractory plate on such side.

7 Claims, 6 Drawing Figures

TENSIONING STRUCTURE FOR A SLIDING CLOSURE UNIT

BACKGROUND OF THE INVENTION

The present invention relates to an improved tensioning structure for a sliding closure unit. More particularly, the present invention is directed to an improved sliding closure unit for controlling the discharge of molten metal from a metallurgical vessel and of the type including a stationary refractory plate to be mounted on the metallurgical vessel with a discharge opening aligned with the discharge nozzle of the metallurgical vessel, a movable refractory plate having a discharge opening, a slide frame supporting the movable refractory plate and movable in a direction of movement between an open position with the discharge openings of the movable and stationary refractory plates in alignment and a closed position with the discharge plates out of alignment, and tensioning means for sealingly pressing the movable refractory plate against the stationary refractory plate, whereby surfaces of the movable refractory plate extending in the direction of movement on opposite sides of the discharge openings are loaded by the tensioning means on the underside of the movable refractory plate, as a result of which the movable refractory plate is pressed toward the stationary refractory plate.

A sliding closure unit of this general type is disclosed in DE-OS No. 21 46 677 and includes two movable refractory plates guided in guide elements and inserted one behind the other in the direction of movement. One movable refractory plate is positioned beneath the discharge nozzle and is pressed by tensioning means against the stationary refractory plate. The tensioning means consists of pivotally mounted levers which pivot about a stationary horizontal axle and pressure springs located in the guide elements. The levers are positioned to extend transverse to the direction of movement. The springs contact first ends of the levers and urge the levers to pivot about the axles and to urge second ends of the levers directly into contact with the movable refractory plate, thereby urging the movable refractory plate toward the stationary refractory plate. A metal shell surrounds the sides and bottom of the movable refractory plate and normally is formed of a soft steel material. The second ends of the levers thereby slidingly contact the bottom of such metal shell. In this arrangement, the levers thereby contact the metal shell at substantially concentrated points, and this creates pressure peaks which have an undesirable effect over the course of the life of the movable refractory plate, which, as is known, is subjected to great wear otherwise during use due to the development of large amounts of heat.

Additionally, development in this technology is to avoid the use of a metal shell having a bottom portion and to simply surround the circumference of the movable refractory plate by a hoop or band of metal. In such an arrangement, the levers would be pressed directly against the hard brittle refractory material of the movable refractory plate, thereby producing in the plate impressions and even cracks.

SUMMARY OF THE INVENTION

Accordingly, it is an object of the present invention to provide an improved tensioning structure for a sliding closure unit whereby it is possible to overcome the above and other prior art disadvantages.

It is a more specific object of the present invention to provide such an improved tensioning structure for a sliding closure unit whereby the force of the tensioning structure is distributed evenly along opposite sides of the movable refractory plate.

It is an even more specific object of the present invention to provide such an improved tensioning structure whereby the levers do not act directly on the movable refractory plate, but whereby the tensioning pressure is optimally transferred to and distributed along the opposite sides of the movable refractory plate by intervening sliding strip members.

Thus, the above objects of the present invention are achieved by the provision of strip members mounted in the slide frame for movement relative thereto in the direction of the thickness thereof, i.e., relatively toward and away from the slide frame. A respective strip member is positioned on each of the opposite sides of the movable refractory plate and is positioned between the respective tensioning means on said side and the bottom surface of the movable refractory plate at such side. Accordingly, the tensioning means, i.e., the levers, press the strip members against the bottom surface of the movable refractory plate along the respective sides thereof. By this simple structural arrangement, the contact pressures resulting from the tensioning means are transferred evenly and in an ideal manner to the movable refractory plate, thus increasing the service life thereof.

The sliding strip members preferably are positioned in respective recesses in opposite sides of the slide frame, and the strip members extend along substantially the entire length of the movable refractory plate in the direction of movement.

Further, each strip member has therein openings which are elongated in the direction of movement and bolts extend through respective elongated openings and are fastened to the slide frame. At least some of the bolts have stop surfaces supporting the respective slide members and limiting the movement thereof away from the slide frame. This prevents the movable refractory plate from falling out of the slide frame when the movable refractory plate is moved to the closed position, i.e., to a position out of the area whereat the movable refractory plate is acted on by the tensioning means. When the movable refractory plate includes two plate portions, i.e., a discharge plate portion and a closing plate portion, when the closing plate portion is out of the area acted on by the tensioning means, then the closing plate portion may be supported within the slide frame simply by cylindrical bolts extending through the elongated grooves and vertically fastened to the slide frame. Spring means may be supported by the slide frame to urge the strip members of the discharge plate portion, or alternatively, of the entire movable refractory plate, toward the slide frame. This makes it possible for such movable refractory plate and the strip members thereof to be satisfactorily introduced between the stationary refractory plate and the tensioning means and causes the movable refractory plate and the slide members thereof to be pressed against a surface on the sliding closure unit housing extending coplanar with the surface of the stationary refractory plate which is acted on by the movable refractory plate.

The tensioning means comprises at least three adjacent pivotally mounted levers positioned on each side of the movable refractory plate, each lever extending transverse to the direction of movement and being pivotable about a stationary axle, and springs acting on first ends of the levers to pivot the levers about the axles and to urge second ends of the levers into sliding contact with the respective strip members. Additionally, the strip members have end shoulders that are spherical or rounded upwardly, particularly on the front ends of the strip members in the direction of their height. As a result, the strip members are allowed to be positioned obliquely in a longitudinal direction relative to the slide frame, thereby enabling the strip members to adapt to irregularities in the underside of the movable refractory plate or plate portions.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
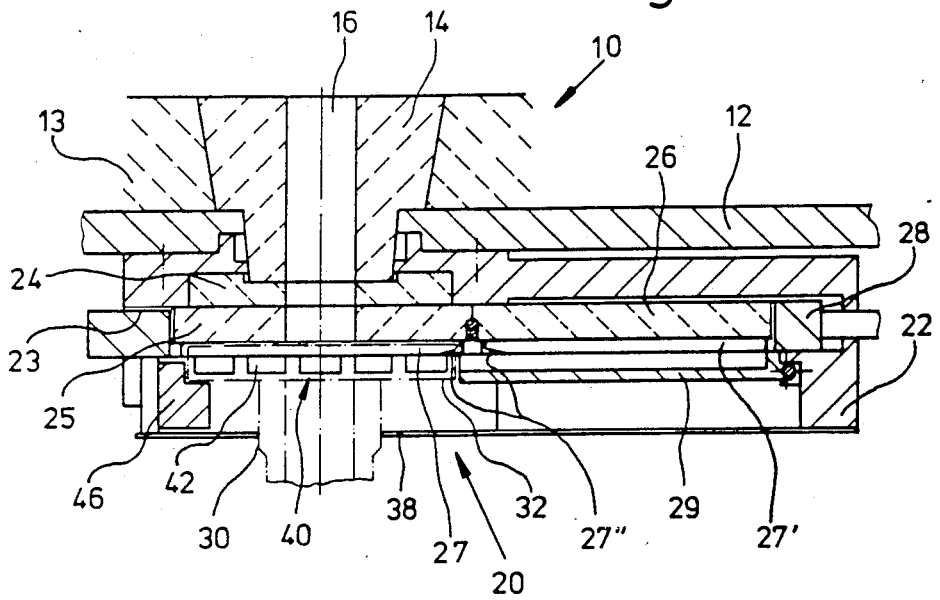
FIG. 1 is a longitudinal section, shown somewhat schematically, of a sliding closure unit in accordance with the present invention and connected to a metallurgical vessel.

In FIG. 1, there is shown a portion of the outlet area of the bottom of a metallurgical vessel 10 including a metal jacket 12, a refractory lining 13, and a discharge nozzle brick 14 extending through refractory lining 13 and having a discharge passage 16. A sliding closure unit 20 includes a stationary housing 22 fixed to metal jacket 12 and supporting a bottom or stationary refractory plate 24 having therethrough a discharge opening aligned with discharge passage 16. Slidably movable within housing 22 is a slide unit including a slide frame 28 supporting a movable refractory plate which, in the illustration of FIGS. 1–3, includes a discharge plate portion 25 and a closing plate portion 26. The slide unit is movable from an open position shown in FIGS. 1 and 2 whereat a discharge opening of the movable refractory plate is aligned with the discharge opening of stationary refractory plate 24, and a closed position whereat such discharge openings are out of alignment and whereat the discharge opening through stationary refractory plate 24 is closed by movable plate portion 26. Thus, the slide unit moves in a direction of movement to the left with respect to FIG. 1 between the open position shown therein and a closed position whereat the discharge opening of stationary refractory plate 24 is closed by movable refractory plate portion 26.

Figure 2:
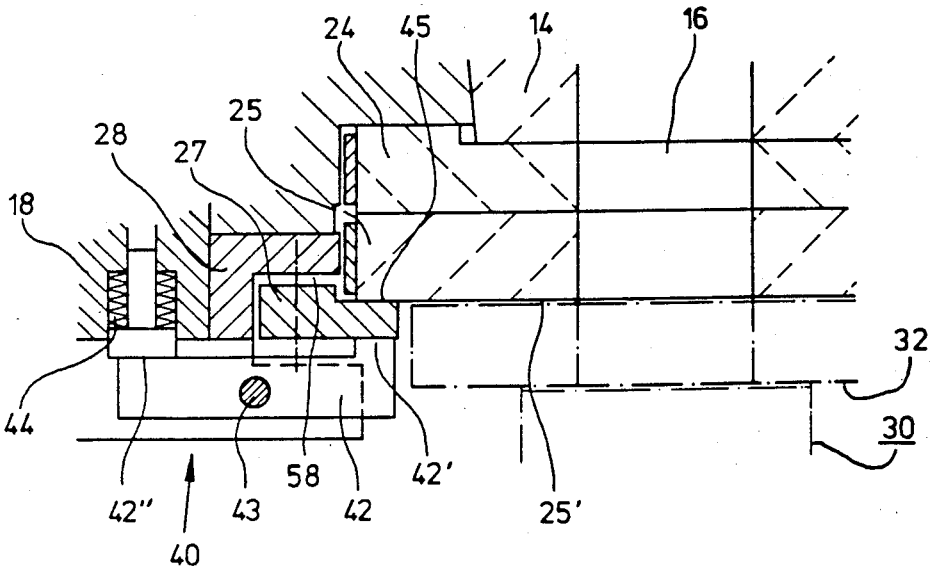
FIG. 2 is a transverse section of a portion of the sliding closure unit shown in FIG. 1.

As shown particularly in FIG. 2, the movable refractory plate, including plate portions 25 or 26, is moved upwardly into sealing contact with the stationary refractory plate 24 by tensioning means 40 in the form of pivotally mounted rocking levers 42 which are tensioned by springs 44, such elements being mounted in replaceable portions or modules 18 connected to housing 22. It will be apparent that when the slide unit moves the movable refractory plate to the closed position, i.e., to the left with respect to the illustration of FIG. 1, then the movable plate portion 25 will be located outwardly of the unit and thereat may be replaced. On the other hand, it will be apparent from a consideration of FIG. 1 that when the movable refractory plate is in the open position shown in FIG. 1, then the plate portion 26 easily may be replaced from below simply by opening pivotally mounted cover 29. It will be understood by those skilled in the art that plate portion 26 requires replacement less often than plate portion 25.

It is contemplated that the sliding closure unit of the present invention may include a lower or locking stationary refractory plate 32 (shown in dashed lines in FIGS. 1 and 2) that can be mounted beneath movable refractory plate 25,26, with a refractory pouring tube 30 fastened to plate 32, for example, by means of an iron shell. In the open position of the sliding closure unit 22 illustrated in FIG. 1, molten metal flows from the interior of metallurgical vessel 10 out through the aligned discharge openings of the above described refractory elements into, for example, a continuous casting mold.

In accordance with the present invention, the levers 42 do not act directly on the bottom surfaces 25',26' of the movable refractory plate portions 25,26. Rather, in accordance with the present invention, there is provided structure for distributing evenly the force of the tensioning means 40 along each of the two opposite sides of the movable refractory plate. Thus, as shown particularly in FIG. 3, a pair of strip members 27 extend along substantially the entire lengths of respective opposite sides of movable plate portion 25. Similarly, strip members 27' extend along substantially the entire lengths of the opposite lateral sides of movable plate portion 26. The strip members 27,27' are fitted within recesses 58,58' formed in respective sides of slide frame 28, and the strip members 27,27' are movable relative to frame 28 in directions of the thickness thereof, i.e., toward and away from frame 28. Thus, as will be apparent from a consideration of FIG. 2 particularly, when movable plate portion 25 is beneath stationary refractory plate 24, springs 44 act on first ends 42'' of levers 42, thereby pivoting the levers 42 about a stationary horizontal axle 43, and urging second ends 42' of the levers into contact with strip members 27. This relationship is provided on each of the opposite lateral sides of the unit, as will be apparent from a consideration of FIG. 3. Thus, the tensioning means 40 press the strip members 27 into contact with the respective sides of undersurface 25' of movable plate portion 25, thereby sealingly pressing movable plate portion 25 against stationary refractory plate 24. In the illustrated arrangement, there are provided five levers 42 on each side of the unit, and preferably there are provided at least three such levers on each side of the unit. Due to the strips 27 being mounted within recesses 58 for movement toward and away from slide frame 28, the pressure of the tensioning means 40 is transferred via the strip members 27 to the movable plate portion 25, but such pressure is evenly distributed along substantially the entire length of a surface area 45 of each side of the movable plate portion.

It will be apparent that when the slide unit is moved to the closed position, whereby movable plate portion 26 is located beneath stationary refractory plate 24, then the tensioning means 40 similarly act via strip members 27' to press against portions 45' of the undersurface 26' of plate portion 26, thereby pressing plate portion 26 against stationary refractory plate 24. As shown somewhat schematically in FIG. 1, the facing ends of the lower surfaces of plate strips 27, 27' may be bevelled as at 27'' to allow ease of movement of the respective plate portions over the various levers 42 during opening and closing movements of the slide unit.

Figure 3:
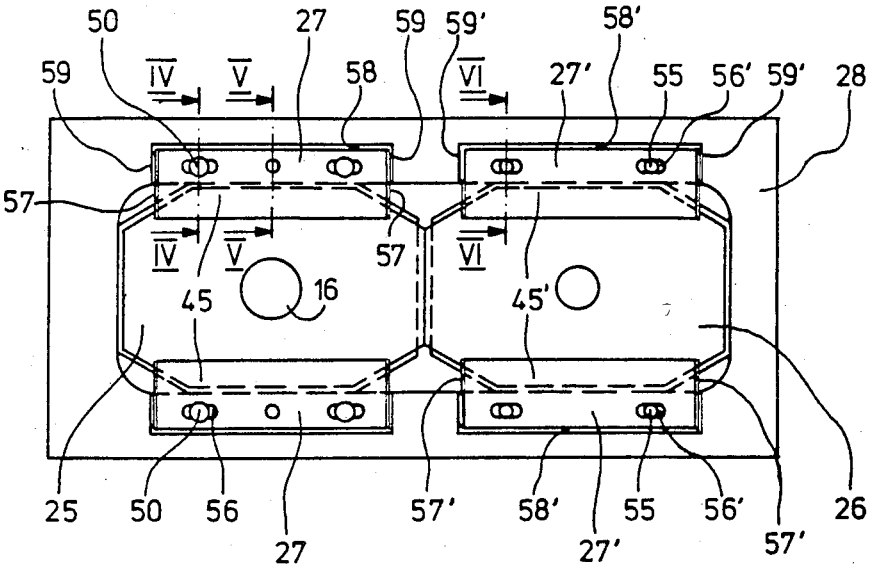
FIG. 3 is a bottom view of the slide frame thereof shown with a pair of attached movable refractory plates and sliding strip members according to the present invention.
Figure 4:
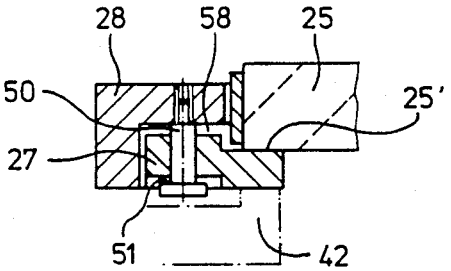
FIGS. 4, 5 and 6 are partial transverse sections taken along lines IV, V and VI, respectively, in FIG. 3.
Figure 5:
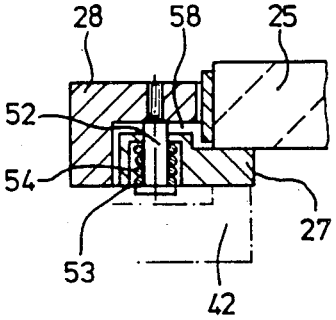

As shown in FIGS. 3 and 4, each strip member 27 has therein openings 56 which are elongated in the direction of movement, and a bolt 50 extends vertically through the mid-portion of each opening 56 and is screwed vertically into slide frame 28. Each bolt 50 is dimensioned so that the sliding strips 27 can move upwardly and downwardly therealong so that they can rest without play on plate underside 25'. Bolts 50 have stop surfaces 51 to limit the movement of slide members 27 away from slide frame 28. Further, as shown in FIG. 5, a further bolt 52 extends through each slide member 27 and is screwed to slide frame 28. A spring 54 is supported on bolt 52 and acts between stop surface 53 and strip member 27 to urge strip member 27 toward slide frame 28. It is intended that springs 54 on opposite sides of the unit together generate a tension force sufficient to overcome the dead weight of plate portion 25 and the weight of respective strip members 27. Thus, when the unit is in the closed position thereof, i.e., with plate portion 25 located to the left of the position shown in FIG. 1 and not acted on by tensioning means 40, then springs 54 maintain the strip members in a position urged upwardly, and further maintain the plate portion 25 against a surface 23 of housing 22 located coplanar with the bottom sliding surface of stationary plate 24. As a result, the plate portion 25 and the slide members 27, by virtue of the bevelled end surfaces 27'' thereof, easily can be inserted between the stationary plate 24 and the tensioning means 40 upon subsequent movement to open the unit.

Figure 6:
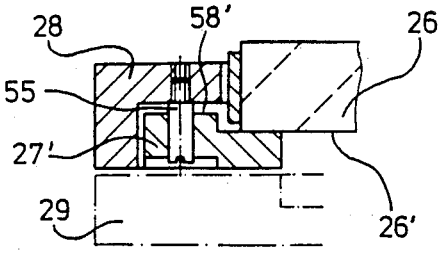

As shown in FIG. 6, the support structure for plate portion 26 need merely be provided with cylindrical bolts 55 extending through strip members 27' and screwed into slide frame 28, thereby maintaining the relative longitudinal and transverse position of the strip members 27'. Cover 29 located beneath slide frame 28 functions as a guide for vertically positioning strip members 27'. When plate portion 26 is to be replaced, i.e, in the positioned shown in FIG. 1, cover 29 simply is pivoted downwardly, whereby strip members 27' and plate portion 26 may be removed.

The strip members 27,27' are positioned in the direction of movement by stop surfaces 59,59' of the respective recesses 58. Further, strip members 27,27' have end shoulders 57,57' which are spherical or rounded upwardly. This makes it possible for the strip members to be positioned obliquely in a longitudinal direction relative to slide frame 28. That is, ends of the strip members are allowed to become inclined upwardly or downwardly with respect to FIG. 1 and into and out of the plane of FIG. 3. This makes it possible for the strip members to adapt to any irregularity in the surfaces of the respective movable plate portions.

Although the present invention has been described and illustrated with respect to a preferred embodiment thereof, it is to be understood that various modifications and changes as would be apparent to one skilled in the art may be made to the specifically described and illustrated structural features without departing from the scope of the present invention. It particularly is understood that the present invention is not limited to an arrangement whereby the movable refractory plate includes two plate portions 25,26. Rather, it is contemplated that the present invention be applicable to a sliding closure unit wherein the movable refractory plate is unitary in construction.

What is claimed is:

1. In a sliding closure unit for controlling the discharge of molten metal from a metallurgical vessel and of the type including a stationary refractory plate, a stationary housing mounting said stationary refractory plate on the metallurgical vessel with a discharge opening of said stationary refractory plate aligned with a discharge nozzle of the metallurgical vessel, a movable refractory plate having a discharge opening, a slide frame supporting said movable refractory plate and movable in a direction of movement between an open position with said discharge openings of said movable and stationary refractory plates in alignment and a closed position with said discharge openings out of alignment, and tensioning means mounted on said stationary housing for sealingly pressing said movable refractory plate against said stationary refractory plate, the improvement comprising means for distributing evenly the force of said tensioning means along opposite sides of said movable refractory plate, which sides extend in said direction of movement, said distributing means comprising:

strip members, separate from said movable refractory plate, mounted in said slide frame for movement relative to said slide frame and relative to said movable refractory plate in the direction of the thickness of said movable refractory plate; and a respective said strip member being positioned on each said opposite side of said movable refractory plate and being positioned between said tensioning means on said side and the bottom surface of said movable refractory plate on said side;

whereby said tensioning means press said strip members toward and against said bottom surface of said movable refractory plate along respective said sides thereof.

2. The improvement claimed in claim 1, wherein said strip members are positioned within respective recesses in opposite sides of said slide frame, and each said strip member extends along substantially the entire length of said movable refractory plate.

3. The improvement claimed in claim 2, wherein each said strip member has therein openings elongated in said direction of movement, and further comprising bolts extending through each said elongated opening and fastened to said slide frame.

4. The improvement claimed in claim 3, wherein at least some of said bolts have stop surfaces supporting the respective said slide members and limiting the movement thereof away from said slide frame.

5. The improvement claimed in claim 4, further comprising spring means supported by said slide frame and urging each said strip member toward said slide frame.

6. The improvement claimed in claim 1, wherein said tensioning means comprises at least three adjacent pivotally mounted levers positioned on each said side of said movable refractory plate, each said lever extending transverse to said direction of movement and being pivotable about a stationary axle, and springs acting on first ends of said levers to pivot said levers about said axles and to urge second ends of said levers into sliding contact with respective said strip members.

7. The improvement claimed in claim 1, wherein said strip members have end shoulders that are rounded, thereby enabling said strip members to be positioned in a longitudinal direction and obliquely relative to said slide frame.

* * * * *